US010537980B2

(12) United States Patent
Schoch

(10) Patent No.: US 10,537,980 B2
(45) Date of Patent: Jan. 21, 2020

(54) METHOD FOR DRY PRODUCTION OF A SLIDING LAYER

(71) Applicant: Robert Bosch GmbH, Stuttgart (DE)

(72) Inventor: Adrian Schoch, Warth (CH)

(73) Assignee: Robert Bosch GmbH, Stuttgart (DE)

( * ) Notice: Subject to any disclaimer, the term of this patent is extended or adjusted under 35 U.S.C. 154(b) by 414 days.

(21) Appl. No.: 15/378,469

(22) Filed: Dec. 14, 2016

(65) Prior Publication Data

US 2017/0173761 A1 Jun. 22, 2017

(30) Foreign Application Priority Data

Dec. 22, 2015 (DE) ..... 10 2015 226 418

(51) Int. Cl.
*B24D 3/34* (2006.01)
*B24D 3/00* (2006.01)

(52) U.S. Cl.
CPC ..... *B24D 3/344* (2013.01); *B24D 3/004* (2013.01)

(58) Field of Classification Search
CPC ..... B24D 3/344; B24D 3/004
See application file for complete search history.

(56) References Cited

U.S. PATENT DOCUMENTS

| | | | | |
|---|---|---|---|---|
| 3,163,968 A * | 1/1965 | Nafus | ..... | B24D 11/02 451/526 |
| 6,077,601 A * | 6/2000 | DeVoe | ..... | B24D 3/28 428/323 |
| 6,228,133 B1 * | 5/2001 | Thurber | ..... | B24D 3/28 51/295 |
| 2003/0176156 A1 * | 9/2003 | Braunschweig | ..... | B24D 3/28 451/526 |
| 2014/0179206 A1 * | 6/2014 | Schoch | ..... | B24D 3/00 451/526 |

FOREIGN PATENT DOCUMENTS

| | | |
|---|---|---|
| DE | 1 944 194 A | 3/1971 |
| DE | 699 04 366 T2 | 10/2003 |
| DE | 602 19 811 T2 | 1/2008 |
| EP | 1 716 972 A1 | 11/2006 |

* cited by examiner

*Primary Examiner* — Pegah Parvini
(74) *Attorney, Agent, or Firm* — Maginot, Moore & Beck LLP

(57) ABSTRACT

A method for dry production of a sliding layer on a flexible backing, in particular a backing that includes a textile or an abrasive backing, includes at least the following. A binder, or more particularly an adhesive such as a hot-applied adhesive or a hotmelt, is applied to a flexible backing. The binder is applied in dry form, such as via scattering, and is joined to the backing via exposure to heat to form a sliding layer on the backing and to hold the sliding layer at least one of on and in the backing. A lubricant, or more particularly a lubricant that includes graphite or PTFE, is applied to at least one of the backing and the binder.

30 Claims, 2 Drawing Sheets

METHOD FOR DRY PRODUCTION OF A SLIDING LAYER

This application claims priority under 35 U.S.C. § 119 to patent application no. DE 10 2015 226 418.1, filed on Dec. 22, 2015 in Germany, the disclosure of which is incorporated herein by reference in its entirety.

The disclosure pertains to a method for dry production of a sliding layer on a flexible backing, more particularly in the form of a textile, more particularly an abrasive backing, comprising at least the following steps:

- applying a binder, more particularly an adhesive, preferably a hot-applied adhesive, more preferably a hotmelt, to the backing and
- applying a lubricant, more particularly a lubricant comprising at least partly graphite or PTFE or consisting thereof, to the backing and/or to the binder.

BACKGROUND

There are methods already known for producing a sliding layer on a backing in the form of a cloth, these methods including the application of a binder and of a lubricant to the backing. The lubricant in such methods is fastened on the cloth by means of a wet-bonding process using a dispersion, and so considerable disadvantages, including that of a transit time in the production of the sliding layer, come about as a result of the wet-bonding process. The uses of these sliding layers include their use with sanding pads provided with a sliding layer, which press a sanding strip onto a workpiece in order to generate an increased frictional force on the workpiece to be machined.

SUMMARY

The disclosure is based on the object of providing, with simple constructional measures, a rapid and simple method for producing a sliding layer on a flexible backing.

The object is achieved by a method for dry production of a sliding layer on a flexible backing, more particularly in the form of a textile, more particularly an abrasive backing, comprising at least the following steps:

- applying a binder, more particularly an adhesive, preferably a hot-applied adhesive, more preferably a hotmelt, to the backing and
- applying a lubricant, more particularly a lubricant comprising at least partly graphite or PTFE or consisting thereof, to the backing and/or to the binder.

In accordance with the disclosure, at least the binder is applied in this case in dry form to the backing, more particularly by scattering, and is joined to the backing with exposure to heat, in order to produce the sliding layer on the backing and to hold the sliding layer on and/or in the backing.

This enables a short and efficient transit time in the production operation, in contrast to the prior art, since there is no drying of the backing or of the sliding layer, a fact which also makes it possible to economize on any production equipment provided in order to supply and remove water or steam. Moreover, the accessibility and handling for an operator are improved in the production process, since the production equipment is of simple and less complex design. Furthermore, the method of the disclosure raises the quality of the backing and of the sliding layer, since no water or steam is required to escape from the sliding layer or the backing during production, meaning that severe shrinkage or contraction of the sliding layer or of the backing is avoided.

Moreover, the porosity of a conventional sliding layer is reduced relative to a porosity of the sliding layer produce by the method of the disclosure. In principle, a lower porosity in the sliding layer helps to make the sliding layer denser and hence also less susceptible to wear. Tests have shown that the service life can be extended by up to 50% by this means.

With the method of the disclosure, furthermore, thicker sliding layers are made possible, relative to the prior art, which are particularly deleterious in the context of wet processes, owing to technical difficulties, such as long and uneven drying of the sliding layer or the formation of bubbles in the sliding layer, for example.

In the case of dry production of the sliding layer, the lubricant is better able to disperse itself between the binder, producing a denser sliding layer. Moreover, in the case of dry application of the binder and/or of the lubricant, the binder and/or the lubricant is distributed more homogeneously parallel to one surface of the backing, so that, for example, a binder which is present in the dry state, as a particle between two lubricant particles, is able to melt on exposure to heat in order to be able to hold the lubricant particles more effectively, by the binder surrounding the lubricant particles to a greater extent. By this means, voids in the sliding layer are prevented as well.

In accordance with the disclosure, at least the binder is applied in dry form to the backing, more particularly by scattering, and is joined to the backing with exposure to heat in order to produce the sliding layer on the backing and to hold the sliding layer on and/or in the backing.

The exposure of the binder and/or the backing to heat may take place with any heat source which appears to a skilled person to be rational. With particular advantage, however, the exposure to heat may take place by means of electromagnetic waves such as microwaves, for example, more particularly with a wavelength in a range from 1 to 300 GHz, or infrared radiation, more particularly with a wavelength in a range from 300 GHz to 400 THz. "Exposure to heat" in this context means the heating of the binder and/or lubricant and/or backing by means of a suitable heat source. Also possible is the use of a preheated binder and/or preheated lubricant, in order to accelerate the method for dry production of the sliding layer.

Where a PTFE material is used as lubricant, the binder can be joined to the lubricant and the backing in a particularly rapid and reliable way, since the PTFE material exhibits only very low absorption of microwave radiation, meaning that essentially only the binder is heated and the thermal loading of the lubricant is minimized.

A "method for dry production" is intended to mean a method where there is essentially no supply and/or removal of liquid. "Essentially no . . . liquid" is intended in this context to mean that liquid is not supplied to or removed from the method in significant proportion. This is not, however, to rule out the binder and/or the lubricant having liquid adhesions on their surfaces, which may come about, for example, as a result of atmospheric moisture. For the purposes of the disclosure, overall, any liquid fraction of the binder and/or lubricant applied to the backing should, however, be less than 5 wt % and preferably less than 1 wt %. A liquid fraction of this low level means that the binder and/or the lubricant can remain free-flowing and/or scatterable and can therefore be easily applied to the backing. A further possibility is that the backing and/or the lubricant take up atmospheric moisture from the ambient air during the dry production method; this, however, is to be disregarded.

"Flexible" in this context is intended to mean bendy or elastic, in particular at least partially, preferably in at least one direction. In this connection, one property of a backing is to change its shape on exposure to force and, when the exposure to force is removed, to revert to the original shape, thus making it possible, for example, for the backing to be reshaped in such a way that, for example, a planar surface of the backing can be bent elastically to form a curved, more particularly a convex and/or concave, surface with a radius of less than 50 cm, more particularly of less than 30 cm, preferably less than 10 cm, without fracturing or creasing in this case.

In a first embodiment, the backing may have an abrasive. The backing may preferably be implemented as an abrasive backing for the sanding of workpieces.

In the first embodiment, preferably, the backing may be configured for the friction-reducing sliding friction of an abrasive which moves relative to the backing, such as a belt abrasive, for example. In that case, the backing may be provided for accommodation in or with a sliding means, more particularly a sanding pad. The backing in this case may serve as a replacement part of the sliding means, more particularly of the sanding pad.

In a second embodiment of the backing, the backing may be implemented as an abrasive backing. In that case, the abrasive backing may be provided for abrasive machining of a workpiece to be machined, by means of an abrasive disposed on the abrasive backing. The backing, more particularly the abrasive backing, may be present in different processed forms, such as, for example, a sanding disk or a sanding belt, more particularly a wide-belt sanding belt. In particular, the abrasive backing may be implemented as a continuous belt.

A "continuous belt" is intended in particular to refer to a belt whose ends are joined to one another. The abrasive backing may also be implemented as an abrasive paper or as an abrasive cloth.

The backing more particularly may comprise or consist of a textile. The textile may preferably comprise or consist of a cotton material. The textile in this case may preferably be woven or knitted. With particular preference, the backing may have a velour or a roughened surface on a side of the backing that is assigned to the sliding layer; as a result, because of the velour joined firmly to the backing, and more particularly surrounding of the binder of the sliding layer, a particularly firm join of the sliding layer to the backing is made possible. The velour may be implemented preferably in one piece with the backing, more particularly firmly joined. The backing of the sliding layer may be any backing customary in the abrasives industry. The velour may be formed in particular as protruding fibers.

The abrasive may be arranged on a side of the backing facing away from the sliding layer. An "abrasive" in this context is intended to refer to an agent which is designed for the abrasive and/or polishing machining of workpieces. The abrasive may have one or more abrasive elements. An "abrasive element" in this context is intended to refer to an element which has a deforming and/or erosive effect on the workpiece to be machined. The disclosure, however, is not confined to a particular abrasive element. The abrasive element may have an abrasive grain, more particularly comprising or consisting of a mineral and/or ceramic material, such as, for example, diamond, corundum, silicon carbide, boron nitride, etc. The abrasive element here may have any geometric design that appears to be rational to a skilled person. The abrasive element may be designed at least in part as an edge, an angle or a sharpening of a surface structure, more particularly of a cellular surface structure of the abrasive, which generates, on the workpiece to be machined, increased friction and development of temperature, which produces a deforming and/or erosive effect on or in the workpiece to be machined.

The binder in particular is free from solvent, and so the binder can be joined quickly and reliably to the backing and lubricant without having to cure for a long time, for example. In this way, furthermore, there is no need for solvents which are hazardous to health, and so occupational safety is increased.

If the lubricant is scattered on, by means of mechanical or electrostatic scattering, for example, the binder in the heated state is able, by virtue of capillary forces, to penetrate the interstices between the lubricant or to fill these interstices, and to hold the lubricant or the sliding layer very stably and effectively on the backing.

The dry-applied lubricant does not penetrate into lower layers of the binder, but instead remains in a concentrated amount at the surface thereof. In relative terms, moreover, the lubricant is distributed parallel to one surface of the backing and/or binder and is therefore dispersed much more homogeneously along the sliding layer. The purpose of the lubricant applied to the backing is, in particular, to move relative to a sliding means, more particularly a sanding pad, of a sanding device and to reduce any friction between the sanding device and the backing. The lubricant, more particularly the graphite or the PTFE material, may be present in the form of a powder, flakes, fibers and/or agglomerates. Contemplated in principle as lubricants, however, are also various other lubricants, such as, for example, molybdenum disulfide or other lubricants meeting the abrasive backing requirements, such as various soft metals and ceramics, for example. The graphite may in particular be formed of a hexagonal boron nitride. All kinds of graphite may be used, particular preference being given to vein graphite, available for example from the company "Kropfmühl", formerly "Branwell Grade 2430".

The lubricant is configured in particular as a dry lubricant and is intended to permit dry sliding friction while avoiding an additional, preferably liquid, lubricant.

The lubricant is present advantageously in particles, which in particular have an average particle size in a range from 30 micrometers to 3 millimeters.

The binder may take the form of a hotmelt adhesive having a melting range in a range from less than 200° C. or more than 160° C. Also possible, however, are hotmelt adhesives with different melting ranges adapted to the requirements of the method. In principle, it is possible to consider a very wide variety of hotmelt adhesives, which on increase in temperature are converted, above a melting temperature, from a solid to a liquid aggregate state. The hotmelt adhesive may advantageously be composed of a base polymer, a resin, a stabilizer, and a natural or synthetic wax.

Preference is given to using a polymer-based hotmelt adhesive, based more preferably on copolyamide or copolyester. Typical representatives of this class of substance are, for example, products of the company EMS, available under the trade name "EMS Griltex".

Furthermore, hotmelt adhesives consisting of polyurethane may be used. In that case, blocked types are also employed, as well as customary hotmelt adhesives. In the case of the blocked types, a more passive reaction partner is provided that is able to enter into a chemical bond with a second reaction partner. Products of this kind are supplied, for example, by the company Bostic.

The detailed description, claims, and drawings specify useful developments of the method of the disclosure.

It may be useful for the binder to take the form of a powder. By this means it is possible, advantageously, to produce a production method that is simple to operate, by the scattering of the binder onto the backing. Likewise, for example, through electrostatic charging of the backing, the binder can be applied homogeneously over at least part of the backing to be coated, thus preventing unevennesses in the binder on the backing. Various powder coating processes would be conceivable here. In one preferred embodiment, the powder may take the form of a hotmelt powder. For example, "Griltex" from EMS may be used as hotmelt. Alternatively or additionally, the binder may be in the form of granules or a sheet.

The binder is present advantageously in particles which have in particular an average particle size in a range from 5 micrometers to 200 micrometers.

It may further be useful for the average particle size of the lubricant to deviate from—and more particularly be greater than—the average particle size of the binder by up to 50%, more particularly by up to 30%, preferably by up to 10%, more preferably by up to 5%. Through this means it is possible for the mixing of the lubricant with the binder to be particularly advantageous. With preference, particles of the lubricant that are as large as possible are used with particles of the binder that are as small as possible.

It may be useful, furthermore, to apply a mixture of the binder and the lubricant to the backing. The mixture of the binder and the lubricant may be premixed, for example, by tumble mixing. Also possible in principle, however, are other mixing methods or mixing modes which appear rational to a skilled person, such as drum mixing, for example. By this means it is possible to save time in the production operation by premixing the binder and the lubricant. As a result of the premixing of the binder and the lubricant, particularly advantageous adhesion is achieved after the heating operation, by the particles of the lubricant being coated with the finer particles of the binder, producing effective adhesion of the particles of the binder to the particles of the lubricant by means of intermolecular forces.

It may, furthermore, be useful for the sliding layer to have a first layer which consists of the binder and the lubricant, more particularly of a mixture of the binder and the lubricant, the first layer being applied to the backing. It may further be useful for the sliding layer to have a first layer which consists only of the binder, the first layer being applied to the backing in order to join it advantageously to the backing. In this case, it is possible advantageously to generate a first layer on the backing, simply and quickly and reliably. In this case, a first layer consisting solely of a binder may have better cohesion than a first layer consisting of a binder and a lubricant, in order to permit a high-strength layer construction.

It may be useful, moreover, for the sliding layer to have a second layer, which consists of the binder and the lubricant, more particularly of a mixture of the binder and the lubricant, the second layer being applied to the first layer.

It may be useful for the sliding layer to have a third layer which consists of the lubricant, the third layer being applied to the second layer. As a result, a particularly advantageous layer sequence of the sliding layer is formed, joined particularly firmly to the backing and to the second layer. Similarly, as a result, the third layer is joined firmly to the second layer, since lubricants of the third layer are able to reach at least partly into the second layer and hence also form an additional form-fitting join in addition to a fusional join of the third layer to the second layer. As a result, an optimum sliding effect can be achieved, since no binder is provided in the third layer. As a result, moreover, the third layer is able to minimize high shearing forces and hence to increase the service life of the abrasive. In particular, the first layer of the sliding layer has a first concentration of the binder, and the second layer of the sliding layer has a second concentration of the binder, the first concentration of the binder being greater than the second concentration of the binder.

It would be conceivable, moreover, for the mixture of the binder and the lubricant to comprise or consist of at least 10%, more particularly 15%, preferably 20%, more preferably 25%, very preferably 30%, of the binder. In this case, with particular advantage, a composition of the binder in the mixture of binder and the lubricant can be adapted individually according to the application scenario, duration of application, conditions of application, such as applied pressure or temperature, for example, and application tolerances.

It would be conceivable, moreover, for the sliding layer to be pressed onto the backing. As a result, the sliding layer, in particular on exposure to heat, can be compressed, thus producing a high-strength sliding layer on the backing. A pressing operation here may take place after or simultaneously with the exposure of the sliding layer to heat. The sliding layer in particular is deformed by means of a pressing operation in such a way that any voids present in the sliding layer are closed or compacted. With preference, the pressing operation on the sliding layer, more particularly on a surface of a sliding layer, may form a structure. The pressing operation may be accomplished preferably using a press, more particularly a forming machine. This enables a greater compression of the sliding layer and may lead to an increase in the service life of the sliding layer. With particular advantage, the pressing operation is pressed with a smooth or unstructured surface, as a result of which the sliding layer likewise receives a smooth surface.

For producing the backing of the disclosure, it would be possible, for example, to use a heatable beltlike press from the Herbert Meyer machine plant.

It may further be conceivable for heat to be removed from the sliding layer and/or the backing in a step which takes place after the exposure of the binder and/or the backing to heat. By this means it is possible to convert the sliding layer very quickly into an end state.

The disclosure relates further to a production means for implementing a method for dry production of a sliding layer on a backing.

The disclosure pertains, furthermore, to a flexible abrasive backing for the abrasive machining of a workpiece, having a backing which has an abrasive layer arranged on a first backing side, and a sliding layer arranged on a second backing side facing away from the first backing side. In accordance with the disclosure, the sliding layer is produced by a method for dry production of a sliding layer on a flexible backing.

The disclosure relates, furthermore, to a lining backing for the abrasive machining of a workpiece, having a backing which has a sliding layer arranged on one backing side. In accordance with the disclosure, the sliding layer is produced by a method for dry production of a sliding layer on a flexible backing.

The disclosure relates, furthermore, to the use of a lining backing separable joining to a sliding means configured as a sanding pad.

BRIEF DESCRIPTION OF THE DRAWINGS

Further advantages are apparent from the drawing description which follows. Depicted in the drawing are exemplary embodiments of the disclosure. The drawing, the description, and the claims contain numerous features in combination. The skilled person will also look individually at the features, judiciously, and will collate them to form rational further combinations.

In the drawing

In the figures which follow, components that are alike are given the same reference symbols.

DETAILED DESCRIPTION

The following figures each pertain to a method for dry production of a sliding layer on a flexible backing. This backing may be implemented as an abrasive backing comprising an abrasive. The backing may be configured as a belt abrasive backing, more particularly as a wide-belt abrasive backing.

In a first embodiment of the backing, the backing may be configured for friction-reduced sliding friction of an abrasive which moves relative to the backing, such as a belt abrasive, for example. In this case, the backing may be provided for accommodation in or with a sliding means, more particularly a sanding pad. The backing in this case may serve as a replacement part of the sliding means, more particularly of the sanding pad.

The backing is intended to be accommodated in a hand-operated sanding device such as, for example, a manual sanding machine, or a fixed sanding device such as a belt sanding machine or a wide-belt sanding machine, for example, and to machine a workpiece, more particularly to sand it and/or polish it, or to guide, in a friction-reduced manner, an abrasive which moves relative to the backing. The sanding device in this case may have at least one sliding means configured as a sanding pad, as evident, for example, from application EP 1 716 972 A1, for pressing the backing onto a workpiece to be machined. The backing in this case may be configured as a continuous belt backing, more particularly wide-belt backing. The backing may alternatively be provided for sliding relative to the pressing means, in operation in or on a sanding device.

Figure 1:
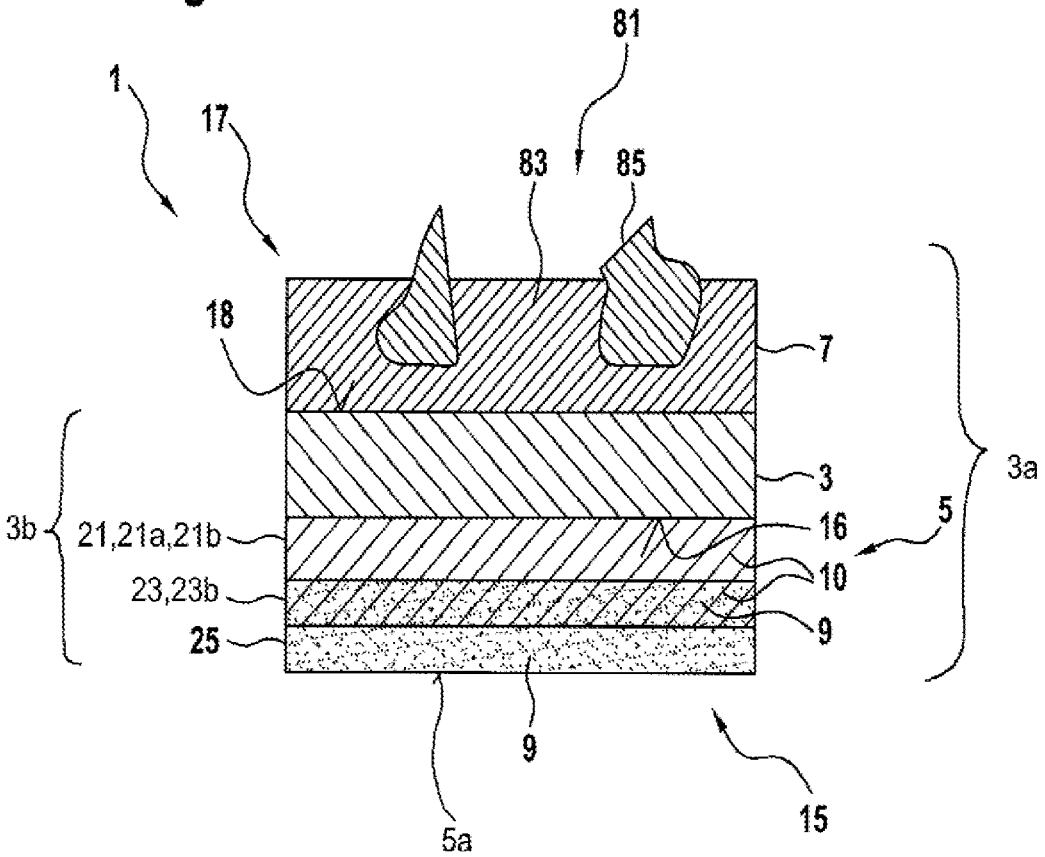
FIG. 1 shows a sectional view of a backing.

FIG. 1 shows a sectional view of an abrasive 1 comprising a flexible backing 3, configured as an abrasive backing and having a first backing side 15 and a second backing side 17 facing away from the first backing side 15. The first backing side 15 of the backing 3 has a first backing face 16. The second backing face 17 of the backing 3 has a second backing face 18.

The first backing side 15 may in particular be lined with a velour, with the result, for example, that the sliding layer 5 may be disposed on the first backing side 15 and/or on the velour of the first backing side 15 and may surround the same in order to permit a firm join of the backing to the sliding layer 5.

The backing 3 has a textile. The textile in particular forms an underlayer for the sliding layer. The textile may be woven or knitted. The textile may comprise or consist of natural or synthetic fibers. The backing 3 may comprise or consist of a cotton material. Alternatively, the backing 3 may at least partly comprise or consist of a paper material. For the backing 3 it is also possible, however, to use other materials which appear to be rational to a skilled person.

Adjoining the first backing face 16 of the backing 3 is a sliding layer 5 for sliding on a sliding means, such as a sanding pad, for example. The sliding layer 5 is joined, in particular fusionally, to the backing.

In a first embodiment of the backing 3, the second backing face 18 of the backing 3 is adjoined by an abrasive layer 7 for machining or sanding of a workpiece. In this first embodiment, the backing 3 serves as an abrasive backing 3*a*, more particularly for operation in a belt sanding device.

In this embodiment, the abrasive layer 7 comprises an abrasive binder 83 and at least one abrasive element 85, in the form of abrasive grain, for the sanding of a workpiece surface. The abrasive layer 7, however, is not confined to this embodiment, but may be implemented as any abrasive layer 7, with at least one abrasive element 85, that is known from the prior art or appears rational to a skilled person. The abrasive element 85 may equally be designed as an edge, an angle or a sharpening suitable for the abrasive machining of workpieces. In this embodiment, the at least one abrasive element 85 is surrounded by an abrasive binder 83 in such a way that at least part of the at least one abrasive element 85 is in freely projecting form. The skilled person is already aware of various abrasive layers 7 on flexible backings 3, and here, therefore, no details will be addressed with regard to construction and composition of the abrasive layer 7.

The abrasive backing 3*a* comprising the abrasive layer 7 and the sliding layer 5. In the first embodiment, the abrasive backing 3*a* is intended in particular for operation with a sanding device not shown in detail, such as a belt sanding machine, for example. In that case, the abrasive backing 3*a* is accommodated in the sanding device comprising a plurality of diverting rollers for tensioning and guiding the abrasive backing 3*a*. The diverting rollers here are in contact with the sliding layer 5 of the abrasive backing 3*a*, and guide the abrasive backing 3*a* at least partly around the diverting rollers. Additionally, the majority of sanding devices have a sliding means in the form of a sanding pad which is intended to be pressed onto the sliding layer 5 in order to press the abrasive layer 7 of the abrasive backing 3*a* against the workpiece to be machined, and to generate an erosive or abrasive action on the workpiece to be machined. With this embodiment it is possible for the sliding means in the form of a sanding pad to have no backing with a sliding layer.

In a second embodiment of the backing 3*b*, the second backing face 18 of the backing 3*b* has no abrasive layer. The second backing face 18 in this case forms a fastening face 18 which is intended at least partly to cover a sliding means, forming a sanding pad 5, of a sanding device. The backing 3*b* here serves as a lining backing for the sanding pad. The backing 3*b* may be accommodated in or with the sanding pad. The sanding pad here has an accommodation region, not shown in detail, having an accommodation face. The sanding pad here accommodates the backing 3*b* in such a way that the second backing face 18 or backing face not provided with the sliding layer is facing the accommodation face of the accommodation region. The connection between the backing face 18 and the accommodation face of the accommodation region here may be a force-fit or frictional fit and/or fusional fit and/or form fit. In particular, the backing 3*b* may be joined firmly to the sanding pad, such as by means of a screw connection, a clamping connection and/or a tensioning connection, for example. Sanding pads of this kind may be found for example in application EP 1 716 972 A1.

The backing 3*b* as well is suitable for accommodation in or with a sanding pad system, with the sanding pad system having at least one backing means, not shown in detail, for accommodating and fixing the backing 3*b*, and a sanding pad device able to join the backing means separably. For this purpose it is possible to use all sanding pads or sanding pad systems that are present on the market, with the backing 3*b* of the disclosure.

Furthermore, provision may be made for the sliding means designed as sanding pad to be provided with the backing 3*b* and to press an abrasive backing 3*a* against a workpiece to be machined, in the operation of a sanding device.

The sliding layer 5 has a joining face, which is joined to the first backing face 16, and a sliding face 5*a*, which faces away from the joining face. The sliding face 5*a* is intended to allow, with reduced friction, sliding on a sliding means in the form of a sanding pad, or of an abrasive in the form of a belt abrasive.

The sliding layer 5 comprises a binder 10 and a lubricant 9 which consists of or comprises a graphite and/or PTFE material. The binder 10 is intended for joining the lubricant 9 to the backing 3.

The sliding layer 5 has a first layer 21 which adjoins the first backing face 16 of the abrasive backing 3 and is joined, more particularly fusionally, to the backing face 16.

The first layer 21 of the sliding layer 5 comprises the binder 10, which is intended to join the second layer 23 to the first backing face 16, more particularly by fusional means and/or by form fit.

The sliding layer 5 has a second layer 23 which adjoins the first layer 21 and is disposed on a side of the first layer 21 that faces away from the backing 3.

The second layer 23 of the sliding layer 5 comprises the binder 10 and the lubricant 9. The second layer 23 is intended in particular for joining the second layer 23 reliably to the first layer 21, more particularly by fusional means and/or by form fit and/or by way of intermolecular forces.

The sliding layer 5 additionally has a third layer 25 which adjoins the second layer 23 and is disposed on a side of the second layer 23 that faces away from the first layer 21.

The third layer 25 of the sliding layer 5 comprises the lubricant 9. The third layer 25 is intended to allow the sliding of a sliding means, such as of a conventional sanding pad, for example, with as little frictional resistance as possible, and so to prevent excessive heating both of the backing 3 and of the sliding means. In order to permit optimum sliding, the third layer 25 preferably has no binder 10.

The binder 10 of the second layer 23 is intended for joining the third layer 25 by means, in particular fusionally and/or form-fittingly and/or by way of intermolecular forces.

Figure 2:
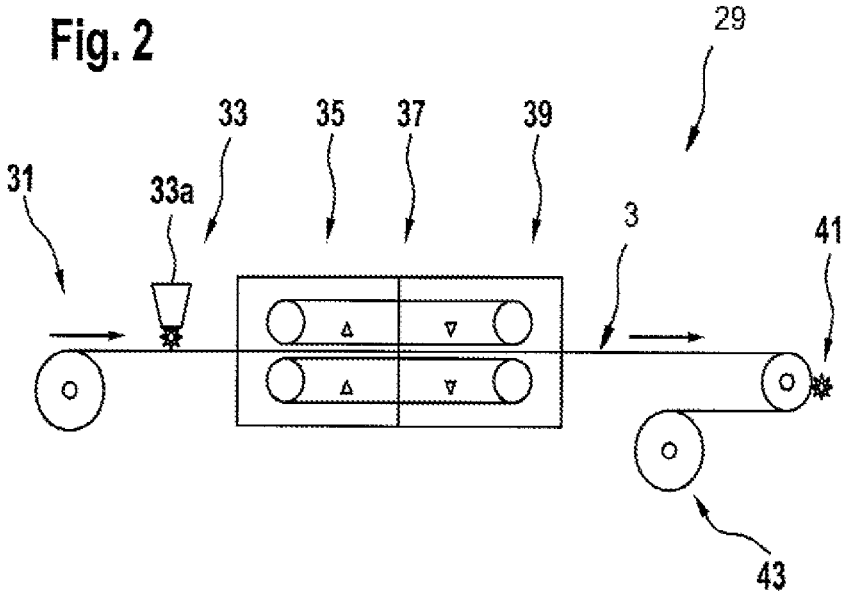
FIG. 2 shows a diagrammatic representation of the production method of the disclosure.
Figure 3:
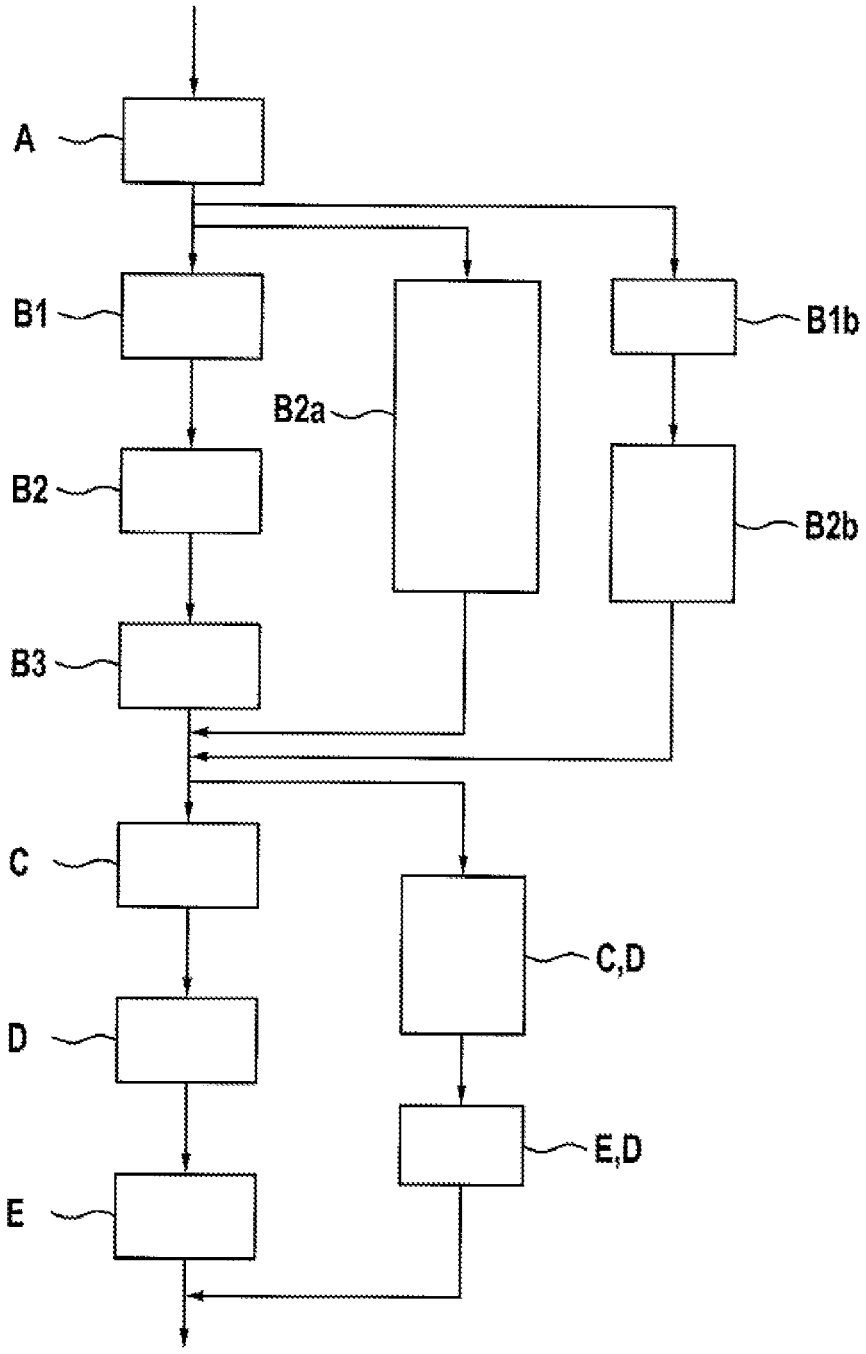
FIG. 3 shows a flow diagram of the method.

FIG. 2 illustrates diagrammatically the production of a backing 3 with a method of the disclosure. The method is shown in FIG. 3 on the basis of a flow diagram. The apparatus 29 used for this purpose—see FIG. 2—comprises an unwind station 31, from which a backing 3 in web form is unwound continuously in a step A, this backing 3 consisting of or comprising, for example, a textile or paper. In the step A, the backing 3 may already be provided with an abrasive layer 7 and already be in the form of an abrasive backing. In the case of a version of the backing 3 without an abrasive layer 7, such a layer may also be applied during the method or in a subsequent method to the second backing side 17 of the backing 3, the side facing away from the sliding layer 5, and may be joined fusionally and/or form-fittingly to the backing 3.

In a scattering station 33, which is known per se, in a step B, which may be subdivided into a plurality of component steps, the sliding layer 5 is applied to the abrasive backing 3. Depending on the preferred embodiment, the sliding layer 5 may comprise a plurality of layers, which are applied, for example, in a sequential series, more particularly a first layer 21, a second layer 23 applied to the first layer 21, and a third layer 25 applied to the second layer 23. The compositions of the respective layers of the sliding layer 5 may be configured in accordance with the composition of the layers from FIG. 1. Here, in a first component step B1, the first layer, comprising or consisting of a binder, is applied or scattered onto the first backing side 15. In a second component step B2, the second layer 23, comprising or consisting of a binder 10 and a lubricant 9, is applied or scattered onto the first layer 21. In a third component step B3, the third layer 25, comprising or consisting of a lubricant, is applied or scattered onto the second layer 23. The scattering station 33 here may comprise a plurality of scattering modules 33*a* which perform the component steps B1, B2, and B3.

Also possible is a sliding layer 5 comprising only one single layer or two layers.

In the case of one embodiment, not shown in detail, with a sliding layer 5 comprising a single layer 21*a*, the layer 21*a* may in particular comprise or consist of a mixture of a binder 10 and a lubricant 9, this mixture being applied or scattered onto the first backing face 16 of the backing side 15 of the backing 3 by means of a single component step B2*a* of the scattering station 33. In this case, the scattering station 33 may advantageously be equipped with only a single scattering module 33*a*.

In the case of a further embodiment not shown in detail, with a sliding layer 5 comprising two layers, a first layer 21*b* may comprise or consist of a binder 10, and a second layer 23*b* may comprise or consist of, in particular, a mixture of a binder 10 and a lubricant 9. The first layer 21*b* may take place by means of a component step B1*b*, by the first layer 21*b* being applied or scattered onto the first backing face 16 of the backing side 15 of the backing 3. The second layer 23*b* may take place by means of a component step B2*b* of the scattering station 33, by the second layer 23*b* being applied to the first layer 21*b*.

By means of a heating station 35, in a downstream step C, the backing 3 and/or the sliding layer 5 are/is heated to a temperature of preferably 20-40° above the melting point of the binder, causing the binder to reach or exceed a binder melting temperature, in order to join—more particularly fusionally—the backing 3 to the lubricant 9. By this means it is possible, for example, for the aggregate state of the binder to change, allowing the binder to flow into and fill pores and vacancies in the sliding layer.

Additionally to the heating station 35 in step C, a pressing station 37 is provided in a step D, which compacts the sliding layer 5 and, in particular, presses it onto the backing 3, thereby compacting or consolidating the sliding layer 5. In this embodiment, step C is combined with step D, and so the pressing station 37 and the heating station 35 are configured integrally in order to achieve rapid throughput of the backing 3. In an alternative version, the step C and the step D may be configured sequentially one after another. By this means, the sliding layer 5, more particularly the binder of the sliding layer 5, is heated by means of the heating station 35 to a binder melting temperature, for example, and is compacted or consolidated, thereby causing the vacancies or cavities formed in the sliding layer in step B, during the scattering of the binder 10 and/or of the lubricant 9 onto the backing 3, to be filled with the binder 10, for example, in step D. As a result, a homogeneous microstructure may come about in the respective layers of the sliding layer 5. The pressing station 37 and the heating station 35 extend for 2 to 9 m, more particularly 3 to 8, preferably 4 to 7 m, more preferably 4 to 6 m, very preferably 4.5 to 5.5 m. The pressing station 37 may be any pressing station which appears rational and suitable to a skilled person in particular for compacting or compressing a sliding layer 5 on a flexible abrasive backing 3.

Although no water is added to the backing 3 and/or to the sliding layer 5, it is possible in the heating station 35 and/or during the heating of the backing 3 and/or the sliding layer 5 for liquid to escape from the binder and/or the lubricant 9, this liquid having been absorbed via the ambient atmospheric moisture, for example, or having been taken up in the base material of the binder 10 or of the lubricant 9.

In a step E which follows step C or step D, a cooling station 39 is provided, which cools the backing and the sliding layer; as a result, the temperature and optionally the aggregate state of the binder 10 changes from liquid to solid, and so the sliding layer and the backing are converted into an end state. In this embodiment, step D of the pressing station 37 and step E of the cooling station 39 overlap one another or are performed simultaneously. Alternatively or additionally, step E may also take place after step D.

In a further step F subsequent to the preceding steps A to D, it is optionally possible for there to be a cleaning station 41 provided, which, by means for example of a brush rotating over the sliding layer, in particular, cleans residues arising from the operation from the backing 3 and/or the sliding layer 5, for example, and ensures that the sliding layer has a uniform and/or smooth sliding face.

What is claimed is:

1. A method for producing a lining for a sanding pad configured to slidingly engage an abrasive, the method comprising:

forming a sliding layer via a dry production process that includes:

applying a binder in dry form to a first face of a flexible backing;

joining the binder to the flexible backing via exposure to heat to form a sliding layer on the flexible backing, and to hold the sliding layer at least one of in and on the flexible backing; and applying a lubricant to at least one of the flexible backing and the binder;

wherein:

a second face of the flexible backing opposite the first face is configured to connect to an accommodation face of a sanding pad, such that the flexible backing forms a lining on the accommodation face and such that the sliding layer is configured to slidingly engage an abrasive supported by the sanding pad; and the lining is free from abrasive material.

2. The method of claim 1, wherein the binder is applied as a powder.

3. The method of claim 1, further comprising:

mixing the binder and the lubricant together prior to applying the binder and lubricant to the flexible backing;

wherein the binder and lubricant are applied to the flexible backing as a mixture to form at least one of the first layer and the second layer of the sliding layer.

4. The method of claim 1, further comprising:

forming a first layer of the sliding layer by either:

applying a mixture of the binder and the lubricant to the flexible backing to form a first layer that consists of the binder and the lubricant; or applying the lubricant to the flexible backing so as to form a first layer of the sliding layer that consists of the lubricant.

5. The method of claim 4, further comprising:

forming a second layer of the sliding layer by either (i) separately applying the binder and the lubricant to the first layer, or (ii) applying a mixture of the binder and the lubricant to the first layer, such that the second layer consists of the binder and the lubricant.

6. The method of claim 3, wherein the binder constitutes at least 10% of the mixture of the binder and the lubricant.

7. The method of claim 6, wherein the binder constitutes about 30% of the mixture of the binder and the lubricant.

8. The method of claim 1, further comprising:

pressing the sliding layer onto the backing.

9. The method of claim 1, further comprising:

after exposing at least one of the binder and the flexible backing to heat during the joining, removing heat from at least one of the sliding layer and the flexible backing.

10. A method of using a lining backing that includes an abrasive layer disposed on a first backing side, and a sliding layer disposed on a second backing side facing away from the first backing side, the sliding layer including (i) a first layer including a lubricant or a binder and the lubricant (ii) a second layer including the binder and the lubricant and (iii) a third layer including the lubricant and free from the binder, the binder applied to the backing in dry form and joined to and held on the backing via exposure to heat, and the lubricant applied to at least one of the backing and the binder, the method comprising:

separably joining the lining backing to a sliding mechanism embodied as a sanding pad.

11. The method of claim 1, wherein the flexible backing includes a textile.

12. The method of claim 1, wherein the flexible backing is an abrasive backing.

13. The method of claim 1, wherein the binder is at least one of a hot-applied adhesive and a hotmelt.

14. The method of claim 1, wherein the binder in dry form is applied to the flexible backing via scattering.

15. The method of claim 1, wherein the lubricant includes or consists of graphite or PTFE.

16. A method for dry production of a sliding layer on a flexible backing, comprising:

applying a binder in dry form to a flexible backing and applying a lubricant to at least one of the flexible backing and the binder to form a sliding layer on the flexible backing, wherein forming the sliding layer includes:

forming a first layer of the sliding layer by either:

applying a mixture of the binder and the lubricant to the flexible backing to form a first layer that consists of the binder and the lubricant; or applying the lubricant to the flexible backing so as to form a first layer of the sliding layer that consists of the lubricant forming a second layer of the sliding layer by either (i) separately applying the binder and the lubricant to the first layer or (ii) applying a mixture of the binder and the lubricant to the first layer, such that the second layer consists of the binder and the lubricant; and forming a third layer of the sliding layer by applying the lubricant to the second layer, such that the third layer consists of the lubricant; and joining the binder to the flexible backing via exposure to heat to form a sliding layer on the flexible backing, and to hold the sliding layer at least one of in and on the flexible backing.

17. The method of claim 16, wherein the binder is applied as a powder.

18. The method of claim 16, further comprising:

mixing the binder and the lubricant together prior to applying the binder and lubricant to the flexible backing;

wherein the binder and lubricant are applied to the flexible backing as a mixture to form at least one of the first layer and the second layer of the sliding layer.

19. The method of claim 18, wherein the binder constitutes at least 10% of the mixture of the binder and the lubricant.

20. The method of claim 19, wherein the binder constitutes about 30% of the mixture of the binder and the lubricant.

21. The method of claim 16, further comprising:

pressing the sliding layer onto the backing.

22. The method of claim 16, further comprising:

after exposing at least one of the binder and the flexible backing to heat during the joining, removing heat from at least one of the sliding layer and the flexible backing.

23. The method of claim 16, wherein the flexible backing includes a textile.

24. The method of claim 16, wherein the binder is at least one of a hot-applied adhesive and a hotmelt.

25. The method of claim 16, wherein the binder in dry form is applied to the flexible backing via scattering.

26. The method of claim 16, wherein the lubricant includes or consists of graphite or PTFE.

27. The method of claim 5, further comprising:

forming a third layer of the sliding layer by applying the lubricant to the second layer, such that the third layer consists of the lubricant.

28. A backing for abrasive machining of a workpiece, comprising:

a sliding layer disposed on a first backing side, the sliding layer consisting of a binder and a lubricant, the sliding layer including:

a first layer including the lubricant or the binder and the lubricant;

a second layer including the binder and the lubricant; and a third layer including the lubricant and free of the binder;

wherein the binder was applied to the backing in dry form, and was joined to and held on the backing via exposure to heat, and the lubricant was applied to at least one of the backing and the binder.

29. The backing of claim 28, wherein the backing is an abrasive backing, and further comprises an abrasive layer disposed on a second backing side facing away from the first backing side.

30. The backing of claim 28, wherein:

the backing is a lining backing that is free from abrasive material; and the lining backing is configured to connect to a sliding pad that is configured to support an abrasive such that the abrasive is slidably engaged with the sliding layer of the lining backing.

* * * * *